US008966861B2

(12) United States Patent
Chang

(10) Patent No.: US 8,966,861 B2
(45) Date of Patent: Mar. 3, 2015

(54) LINING BOARD USING OF MULTI-LAYER FIBER SHEET

(75) Inventor: Chun Ho Chang, Daegu-si (KR)

(73) Assignee: Keinyung University Industry Academic Cooperation Foundation, Daegu-Si (KR)

( * ) Notice: Subject to any disclaimer, the term of this patent is extended or adjusted under 35 U.S.C. 154(b) by 109 days.

(21) Appl. No.: 13/310,745

(22) Filed: Dec. 3, 2011

(65) Prior Publication Data

US 2013/0058089 A1 Mar. 7, 2013

(30) Foreign Application Priority Data

Sep. 2, 2011 (KR) ..... 10-2011-0089125

(51) Int. Cl.
*E04C 2/36* (2006.01)
*F21V 21/00* (2006.01)

(52) U.S. Cl.
CPC ..... *F21V 21/00* (2013.01)
USPC ..... 52/793.1; 52/650.3; 52/783.17; 52/783.1; 428/118

(58) Field of Classification Search
USPC ..... 52/793.1, 650.3, 794.1, 783.11, 783.17, 52/783.18, 783.19, 790.1, 783.1; 428/116, 428/118
See application file for complete search history.

(56) References Cited

U.S. PATENT DOCUMENTS 3,687,223 A * 8/1972 Streck ..... 181/292
3,709,161 A * 1/1973 Kauffman ..... 108/57.34
3,753,843 A * 8/1973 Hutchison ..... 428/116
4,336,292 A * 6/1982 Blair ..... 428/116
5,041,323 A * 8/1991 Rose et al. ..... 428/116
5,460,865 A * 10/1995 Tsotsis ..... 428/116
5,543,198 A * 8/1996 Wilson ..... 428/116
5,804,030 A * 9/1998 Jaegers et al. ..... 156/510
5,894,044 A * 4/1999 Norcom et al. ..... 428/116
6,061,993 A * 5/2000 Bendixen et al. ..... 52/783.19
6,344,253 B1 * 2/2002 Pioventini ..... 428/73
6,371,242 B1 * 4/2002 Wilson et al. ..... 181/292
6,544,624 B1 * 4/2003 Lopez-Anido et al. ..... 428/118
6,830,796 B2 * 12/2004 Murray et al. ..... 428/73
7,143,564 B2 * 12/2006 Renck ..... 52/783.17
7,581,366 B2 * 9/2009 Smith et al. ..... 52/794.1
2002/0014051 A1 * 2/2002 Fraval et al. ..... 52/794.1
2002/0094412 A1 * 7/2002 Murray et al. ..... 428/116
2002/0170265 A1 * 11/2002 Tokonabe et al. ..... 52/793.1
2004/0074205 A1 * 4/2004 Stache ..... 52/783.11
2004/0078976 A1 * 4/2004 Ahn et al. ..... 29/897.32
2004/0128939 A1 * 7/2004 Kim et al. ..... 52/650.3
2005/0262801 A1 * 12/2005 Landwehr et al. ..... 52/793.1
2006/0000186 A1 * 1/2006 Carlson et al. ..... 52/793.1
2007/0048084 A1 * 3/2007 Jung et al. ..... 404/9

FOREIGN PATENT DOCUMENTS

KR 2010-0078142 A 7/2010

* cited by examiner

*Primary Examiner* — Brian Glessner
*Assistant Examiner* — Jessie Fonseca
(74) *Attorney, Agent, or Firm* — Revolution IP, PLLC

(57) ABSTRACT

A lining board includes: a plate-like support structure which is made of a multi-layered fiber sheet and has a plurality of hollows; and an upper plate which is attached to the top of the support structure and has a plurality of LED leading lightings formed on the top of the upper plate. The honeycomb-structured lining board including fiber sheets stacked with a predetermined thickness has advantages of lightness, high impact-resistance and high noise-proofing due to high sound absorptiveness.

3 Claims, 6 Drawing Sheets

LINING BOARD USING OF MULTI-LAYER FIBER SHEET

BACKGROUND OF THE INVENTION

1. Field of the Invention

The present invention relates to a lining board, and more particularly, to a lining board using a multi-layer fiber sheet which is light, strong, corrosion-resistant, impact-resistant and noise-proof.

2. Description of the Related Art

In construction of temporary bridges or facilities for traffic detour, an infrastructure including molds (typically H-beams) is mounted on piles typically hammered or interpenetrated into the ground and then a plurality of rectangular parallelepiped steel lining boards are temporarily interconnected on the top of the infrastructure for temporary traffic flow. Such steel lining boards are also utilized for road lining after excavation in subway construction sites.

A lining board, which is a kind of construction materials, refers to a floor slab having certain width and length to allow vehicles to run, which covers underground steel frames for road lining in excavation and construction of an underground structure in a downtown area or is mounted on a girder in construction of a temporary bridge.

Conventional lining boards were mainly made of steel. However, such steel lining boards are very slippery, particularly in the event of snow or rain, which may bring about frequent traffic accidents.

In addition, a steel lining board is relatively expensive and gives rise to large vibration and noise which may make local inhabitants so uncomfortable as to incur a civil compliant. In addition, since the steel lining board is fabricated by means of welding, it is susceptible to fatigue due to vibration and impact repeatedly transferred to welding connections, which may be caused by vehicular traffic.

As a measure against such vibration and impact, there has been proposed a technique in which the steel lining board is paved with asphalt, urethane, aggregate or other materials or is combined with a concrete layer. However, the steel lining board of this technique is still susceptible to fatigue and has other problems of some noise and complexity and diseconomies in fabrication.

In addition, the conventional steel lining boards have the standard dimension of 2,000 mm (in length)×750 nm (in width)×200 nm (in height). However, such conventional steel lining boards are so massive as to use heavy equipment to transport and install them, which may result in increase in construction costs. Therefore, there is a need to develop a technique for a new lining board which can replace the existing steel lining board.

FIG. 1 shows a fiber reinforced polymer lining board 10 developed to meet this need. As shown in FIG. 1, the lining board 10 is fabricated in the form of a box having a plurality of hollows 20 which extend longitudinally.

Specifically, the lining board 10 has a body which is partitioned by internal hollows 10 and generally includes an upper flange 11, a vertical abdominal part 12 and a lower flange 13. Further, as shown in FIG. 2, a fiber reinforced polymer lining board has been introduced which includes an abrasive layer 30 formed on the upper flange in the lining board 10.

In more detail, if the top of the lining board 10 made of the fiber reinforced polymer as shown in FIG. 1 is not further treated, a slip effect may occur. If an anti-sliding means (for example, concavo-convex surfaces) is formed to prevent such a slip effect when the lining board is fabricated, the top of the lining board becomes worn with the lapse of time and accordingly the lining board, which is relatively expensive, may have to be replaced with new ones. Accordingly, a new lining board made of fiber reinforced polymer and including additional abrasive layers 30 formed on the top of the lining board is provided in such a manner that the abrasive layers 30 can be freely replaced to allow use of the lining board made of more economical fiber reinforced polymer. In addition, concavo-convex surfaces may be formed on the abrasive layers 30 to prevent a slip effect.

In addition, a fiber reinforced polymer lining board including a non-slip layer, and a temporary bridge constructing method using the same have been introduced. Specifically, as shown in FIG. 3, a non-slip layer 40, which can be freely replaced and act as a pavement layer, is formed on the top of the lining board made of fiber reinforced polymer.

However, the conventional lining boards made of fiber reinforced polymer have disadvantages of high production costs, low robustness to a vertical force due to longitudinal hollows, and relative large noise in traveling of cars although smaller than steel lining boards.

SUMMARY OF THE INVENTION

To overcome the above problems, it is an object of the invention to provide a lining board which is light and has high strength, impact-resistance and noise-proofing. It is an object of the invention to provide a lining board which can be easily installed, has a high degree of freedom of installation and is convenient in removal and management after completion of construction.

To achieve the above objects, according to an aspect of the invention, there is provided a lining board including: a plate-like support structure which is made of a multi-layered fiber sheet and has a plurality of hollows; and an upper plate which is attached to the top of the support structure and has a plurality of LED leading lightings formed on the top of the upper plate.

Preferably, the multi-layered fiber sheet is made of glass fiber or carbon fiber, the hollows are of a honeycomb shape, and the upper plate is made of steel or carbon fiber.

Preferably, a concrete layer is formed on the top of the upper plate, the concrete layer contains coarse aggregates to be exposed from a surface of the concrete layer, and the lining board comprises a plurality of lining board blocks coupled in a horizontal direction, each of which includes the support structure and the upper plate.

According to the present invention, the honeycomb-structured lining board including fiber sheets stacked with a predetermined thickness has advantages of lightness, high impact-resistance and high noise-proofing due to high sound absorptiveness.

In addition, the inventive lining board has advantages of easy installation, a high degree of freedom of installation depending on road size and length and easy removal after completion of construction. In addition, the inventive blocked lining boards have another advantage of convenient movement and management since they can be stacked after being removed.

DETAILED DESCRIPTION OF PREFERRED EMBODIMENTS

Hereinafter, preferred embodiments of the present invention will be described in detail with reference to the accompanying drawings.

Figure 1:
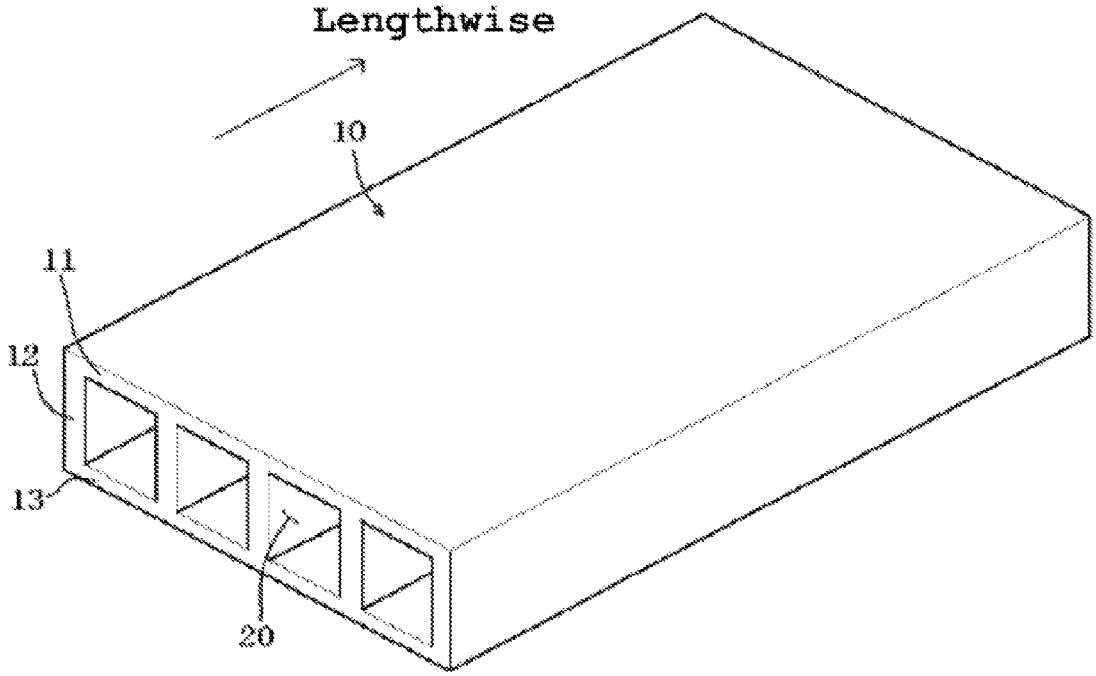
FIG. 1 Prior Art
FIG. 1 is a view showing a conventional lining board made of a fiber reinforced polymer.
Figure 2:
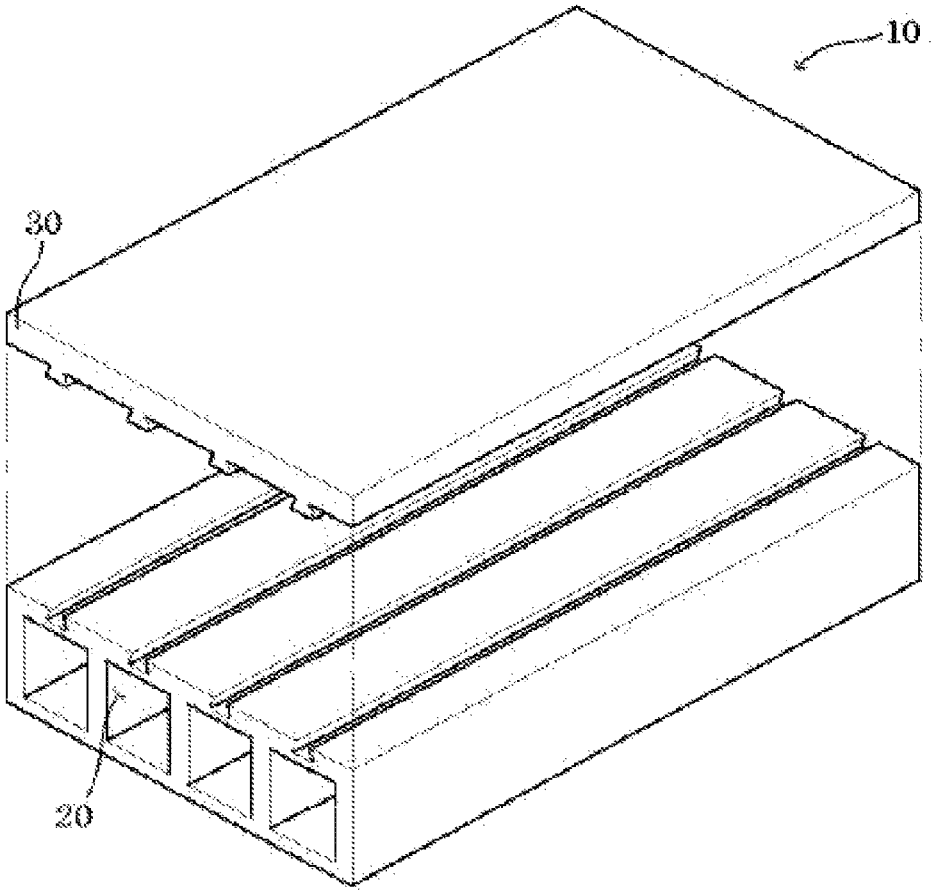
FIG. 2 Prior Art
FIG. 2 is a view showing a conventional upper plate separation type lining board made of a fiber reinforced polymer.
Figure 3:
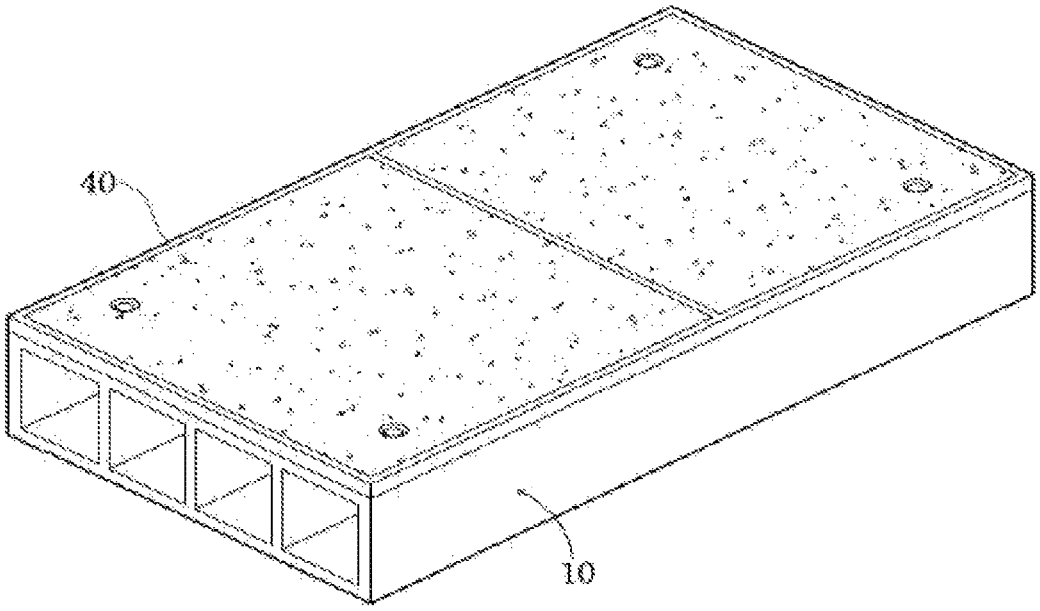
FIG. 3 Prior Art
FIG. 3 is a view showing a conventional lining board which is made of a fiber reinforce polymer and includes a non-slip layer.
Figure 4:
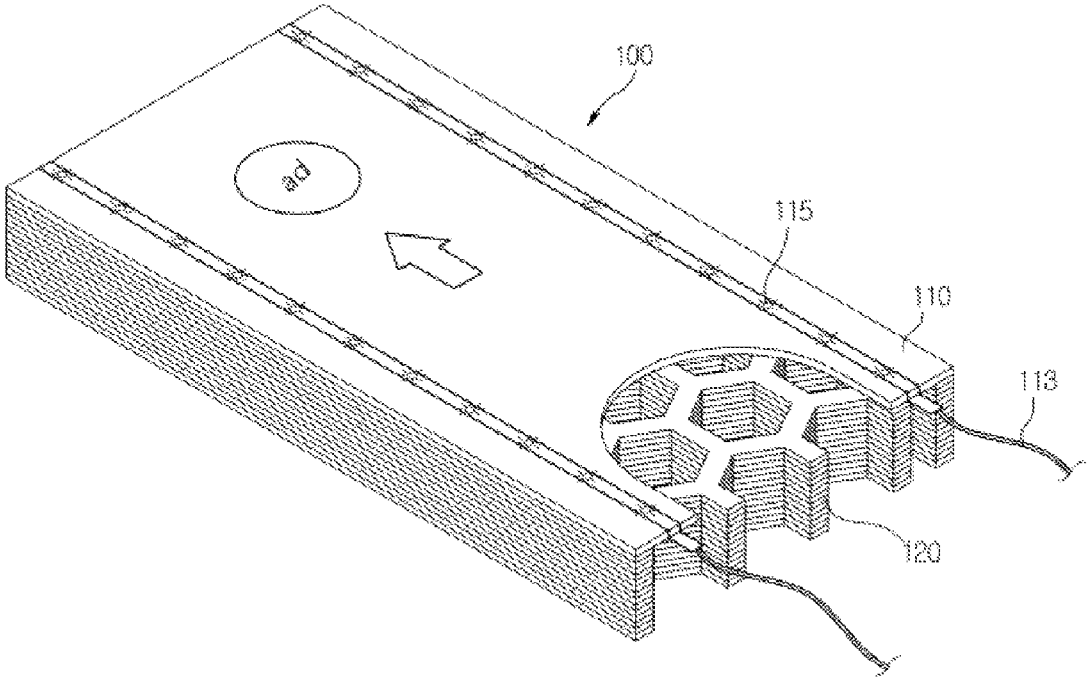
FIG. 4 is a perspective view showing a configuration of a lining board made of a multi-layered fiber sheet according to an embodiment of the present invention.
Figure 5:
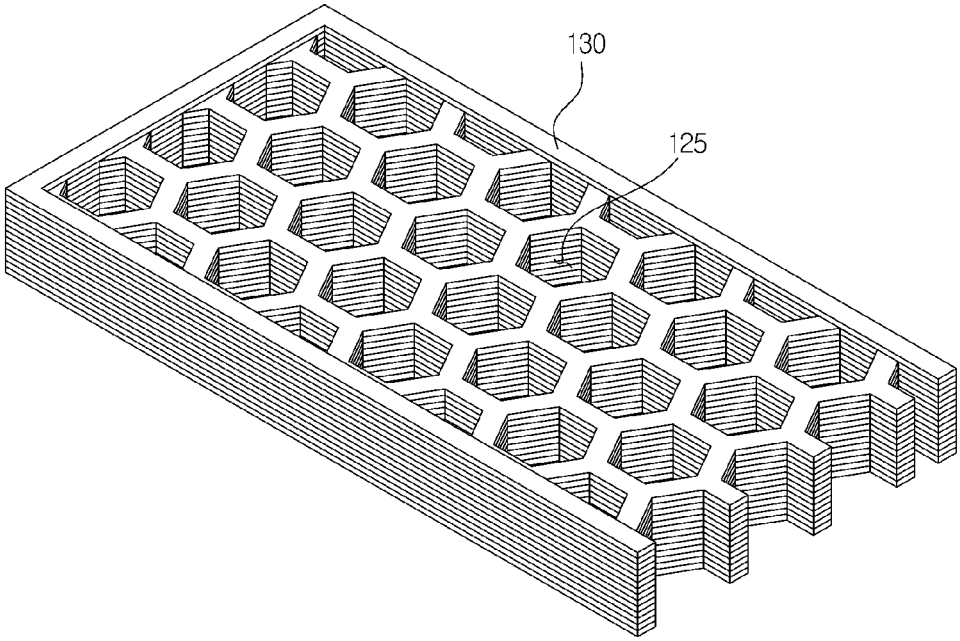
FIG. 5 is a view showing a support structure using the multi-layered fiber sheet applied to the lining board according to an embodiment of the present invention.

FIG. 4 is a perspective view showing a configuration of a lining board 100 made of a multi-layered fiber sheet according to an embodiment of the present invention and FIG. 5 is a view showing a support structure 130 using the multi-layered fiber sheet applied to the lining board 100 according to an embodiment of the present invention. As shown in FIG. 4, the lining board 100 is made of a multi-layered fiber sheet and includes a plate-like support structure 120 having a plurality of hollows; and an upper plate 110 which is fixedly mounted on the support structure 120, with an LED guide lighting buried in the top side of the plate 110.

As described above, a lining board as a kind of construction materials is a floor slab having certain width and length to allow vehicles to run, which covers underground steel frames for road lining in excavation and construction of an underground structure in a downtown area or is mounted on a girder in construction of a temporary bridge. Therefore, the lining board has to act as a stable support plate and be easily installed and removed and has a problem of noise caused by iron plate used in the lining board, unlike general concrete or asphalt.

The present invention proposes the lining board 100 using a multi-layered fiber sheet support structure which can be easily installed and reduce noise most significantly and is light and excellent in its strength. As shown in FIGS. 4 and 5, the lining board 100 includes the support understructure 120 composed of multiple layers of densely stacked fiber sheets, each having a plurality of hollows, and the upper plate 110 mounted on the support structure 120.

As used herein, a fiber sheet may be made of glass or carbon fiber which may be also used as material of the upper plate 110.

The glass fiber may be also used as an insulating material when thread or cloth is fabricated, or as a reinforcing material of plastics. The glass fiber has the following properties: high heat-resistance and flame-resistance, anti-corrosiveness due to chemical durability, high strength, particularly high tensile strength, low elongation and high electrical insulation, high abrasion-resistance, adiabaticity and soundproofing. Accordingly, when the lining board 100 of this invention is made of the glass fiber, it is possible to provide a high quality lining board 100 having anti-corrosiveness, lightness, high tensile strength and high adiabaticity and soundproofing.

The carbon fiber is a fiber made by heating and carbonizing an organic fiber in inert gas and has strength of 10 to 20 g/d and specific gravity of 1.5 to 2.1. In addition, the carbon fiber has high heat-resistance and impact-resistance. Further, this is lighter than metal (for example, aluminum) and has elasticity and strength superior to metal (for example, iron) since molecules of oxygen, hydrogen, nitrogen and so on are escaped from the carbon fiber in a heating process. The carbon glass having such merits can be appropriately used for the entire support structure of the lining board 100 of this invention.

In this way, as the support structure 120 of the lining board 100 of this invention is made of the fiber sheet and is formed by stacking the plurality of fiber sheets, each having a plurality of hollows 125, it is possible to provide the lining board 100 having high strength, lightness, anti-corrosiveness and high noise-proofing.

In addition, as shown in FIG. 5, the above-mentioned hollow shape is preferably of a honeycomb structure which may be frequently used for a thin plate made of paper, plastics, aluminum or steel because of its lightness and robustness to bending or compression. In the present invention, a honeycomb structure formed by stacking the fiber sheets with a predetermined thickness is preferably used for the support structure 130 to provide lightness, high strength, high impact-resistance and high noise-proofing.

In addition, as shown in FIG. 4, the upper plate 110 of the lining board 100 of this invention is supported by the support structure 120. Since the upper plate 110 contacting wheels of cars and has to perform a variety of road functions, it has to have a high strength and a proper friction for prevention of slide. In addition, road signs have to be easily installed in the upper plate 110.

Accordingly, in this invention, the upper plate 110 may be made of glass fiber, carbon fiber, thin and light aluminum or the like. In addition, a concrete layer may be formed on the upper plate 110 to provide a specific friction and some of coarse aggregates contained in the concrete layer may be exposed to promote an anti-sliding function.

In addition, as shown in FIG. 4, a plurality of LEDs 115 acting as road signs or road leading lamps may be buried in the lining board 100 of this invention through conductors 113. The LED line has a merit of its easy installation in the lining board 110 and low power consumption. In addition, a variety of advertisements or road signs may be attached to one side of the upper plate 110.

Figure 6:
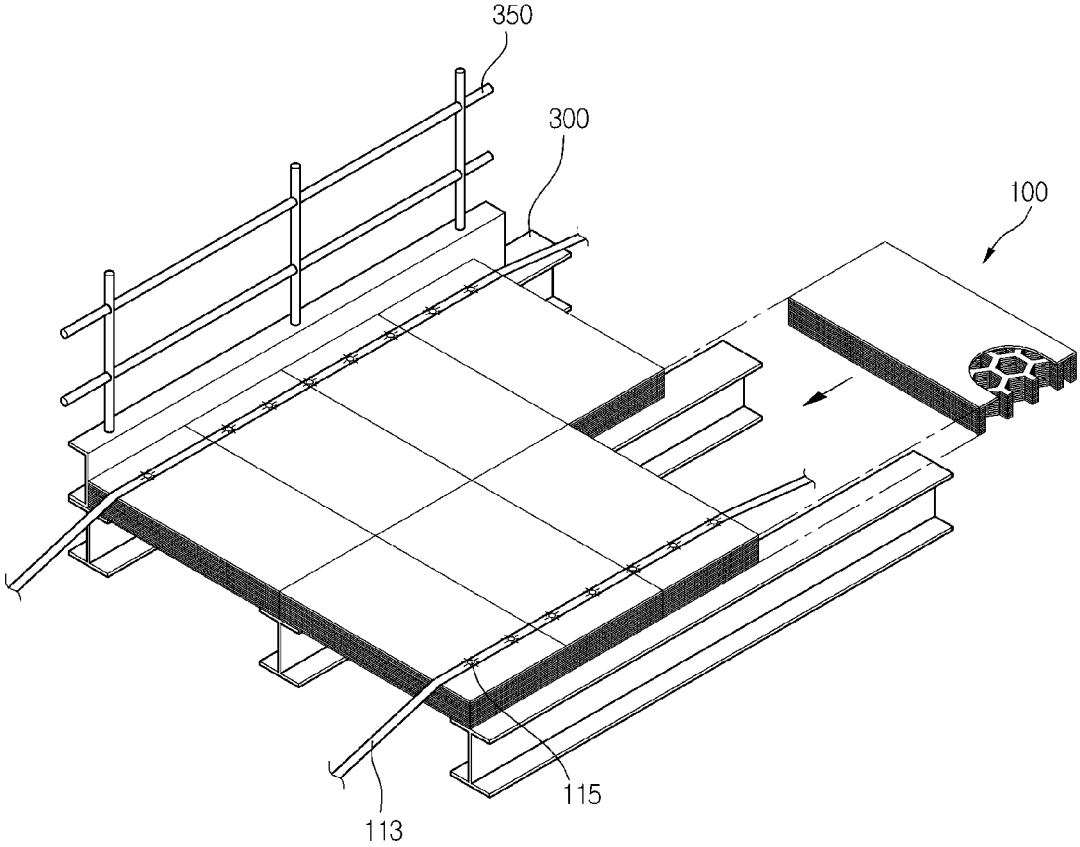
FIG. 6 is a schematic view showing a state where lining boards made of a multi-layered fiber sheet are installed according to another embodiment of the present invention.

FIG. 6 is a schematic view showing a state where lining boards 100 made of a multi-layered fiber sheet are installed according to another embodiment of the present invention. As shown in FIG. 6, a lining board road is constructed by horizontally coupling and arranging lining board blocks 100 on temporary bents 300 and 350 which are steel skeleton structures installed in a construction site. Each of the lining board blocks 100 includes a support structure 120 made of a honeycomb-structured multi-layered fiber sheet, and an upper plate 110 attached to the top of the support structure 120, as shown in FIG. 4. A large-scaled lining board 100 having a specified area is formed by connecting the lining board blocks 100 in the horizontal direction.

As described above, the use of the lining board blocks 100 as in the embodiment of the present invention provides merits of easy installation, a high degree of freedom of installation depending on road size and length and easy removal after completion of construction. In addition, the lining board blocks 100 have another merit of convenient movement and management since they can be stacked after being removed.

Although a few exemplary embodiments have been shown and described, it will be appreciated by those skilled in the art that adaptations and changes may be made in these exemplary embodiments without departing from the spirit and scope of the invention, the scope of which is defined in the appended claims and their equivalents.

What is claimed is:

1. A lining board comprising:

a plurality of lining board blocks;

each of the lining board blocks comprising a support structure formed by a multi-layered fiber sheet, each layer of the multi-layered fiber sheet comprising an array of a plurality of hexagonal-shaped cells, the support structure being formed by stacking each layer of the multi-layered fiber sheet, wherein each of the hexagonal shaped cells comprise a hexagonal hollow;

an upper plate, which is attached to a top layer of the multi-layered fiber sheet of each lining board block, and respective ones of six vertices and six lines of each of the plurality of hexagonal-shaped cells are all aligned and are stacked in a vertical direction to support the respective upper plate;

a concrete layer formed on a portion of the top of each upper plate and comprising coarse aggregates exposed from a surface of the concrete layer; and an LED line module formed in a line of LEDs attached to each concrete layer in a longitudinal direction.

2. The lining board according to claim 1, wherein each of the plurality of lining board blocks is coupled in a horizontal direction to meet a width and a length to allow vehicles to run, each of which lining board blocks comprises the support structure and the upper plate attached to the top of the support structure.

3. The lining board according to claim 1, wherein each multi-layered fiber sheet comprise glass fiber or carbon fiber.

* * * * *